United States Patent [19]

Folgerö

[11] Patent Number: 4,865,234

[45] Date of Patent: Sep. 12, 1989

[54] POURING CONTROL DEVICE

[75] Inventor: Kare Folgerö, Västerås, Sweden

[73] Assignee: ASEA Brown Boveri AB, Västerås, Sweden

[21] Appl. No.: 154,367

[22] Filed: Feb. 10, 1988

[30] Foreign Application Priority Data

Mar. 26, 1987 [SE] Sweden ..... 87012613

[51] Int. Cl.[4] ..... B22C 19/04

[52] U.S. Cl. ..... 222/597; 266/94

[58] Field of Search ..... 266/45, 94, 99, 236; 222/594, 597, 600; 164/449, 154

[56] References Cited

U.S. PATENT DOCUMENTS 4,279,149 7/1981 Block ..... 164/449

4,349,066 9/1982 Schmid et al. ..... 164/449

4,570,230 2/1986 Wilson et al. ..... 164/449

*Primary Examiner*—S. Kastler

*Attorney, Agent, or Firm*—Kenyon & Kenyon

[57] ABSTRACT

A device for control of the pouring process in molds, wherein molten metal is adapted to be tapped from a vessel (e.g. a pouring furnace, a ladle or a tundish) provided with a stopper or other flow-control valve means. Between the vessel and the mold at least one transmitter coil and at least one receiver coil are positioned for measuring the degree of filling of the mold, suitably in a pouring cup. The output signal from the receiver coil is supplied to a signal processing device for control of the flow-control valve means.

2 Claims, 1 Drawing Sheet

POURING CONTROL DEVICE

TECHNICAL FIELD

The present invention relates to a device for control of the pouring process in casting molds, wherein a molten metal is adapted to be tapped from a pouring furnace, a ladle or a tundish, provided with a stopper or other valve member.

DISCUSSION OF PRIOR ART

In this kind of pouring process, it is desired to control the pouring operation such that the volume of molten metal poured is controlled in a precise manner. Different level measuring devices are available on the market, but these are either too expensive, too inaccurate or too unreliable in operation, or else they require the use of a special pouring cup. In addition, from an environmental aspect, the use of such known devices may also cause problems.

SUMMARY OF THE INVENTION

A device according to the invention aims to provide a solution to the problems mentioned above and other related problems and is characterized in that between the furnace and the casting mold there is arranged at least one transmitter coil and at least one receiver coil for measuring the degree of filling of the mold, suitably in a pouring cup, whereby the output signal from the receiver coil is supplied to a signal processing device for control of a flow-control valve means.

With a device as described above, the quantity of molten metal supplied to a mold, a pouring cup or a casting ball can be controlled in an efficient way. It is also possible to arrange for the pouring to be carried out in a manner which is quite excellent from the point of view of environmental considerations. As an example of a measuring device which can be used in connection with the invention can be mentioned the device disclosed in Linder's U.S. Pat. No. 4,138,888 which uses a transmitter coil and a receiver coil, albeit in an application different from that described herein.

BRIEF DESCRIPTION OF THE DRAWING

The invention will now be described in greater detail, by way of example, with reference to the accompanying drawing, wherein.

DESCRIPTION OF PREFERRED EMBODIMENT

Figure 1:
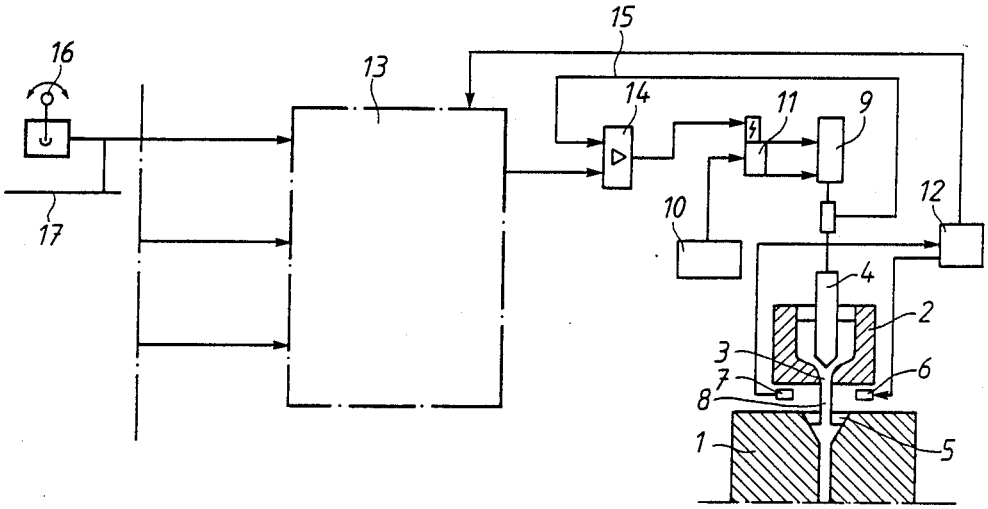
FIG. 1 shows a block diagram and casting means for the device.

The mold is shown at 1 and may consist of a casting ball, a mold flask or any other casting mold intended for intermittent pouring, and it is desired to obtain an accurately adapted volume of molten metal by using this device. Molten metal is tapped from a vessel 2 (e.g. a pouring furnace, a tundish or a ladle) provided with flow-control valve means 4 (shown as a stopper rod) for closing a bottom tap hole 3. Alternatively in place of a stopper some other form of valve member, such as a sliding valve (not shown), can be used. The mold 1 is provided with an extended portion, a so-called pouring cup 5. A transmitter coil 6 and a receiver coil 7 are located on either side of the stream of melt 8 leaving the tap hole 3 between the pouring furnace 2 and the mold 1. The coils 6, 7 form a measuring device but an alternative measuring device of electromagnetic type can also be used. The stopper rod 4, for closing the tap hole 3, is suitably moved by means of a hydraulic cylinder 9, which receives pressurized hydraulic medium from a container 10, the supply being controlled via a valve member 11.

From the transmitter coil 6, an electromagnetic field is emitted, which is received by the receiver coil 7. The output signal from the transmitter coil 6 and the reception of the signal by the coil 7 are processed by an indicator device 12. When the melt reaches up to a certain level in the pouring cup 5, which is suitably pre-settable, the indicator device 12 receives a signal from the coil 7, and an impulse for adjustment of the position of the stopper rod 4 can be obtained. The indicator device 12 is connected to a computer 13, the output signal of which, as well as a signal setting the actual position of the stopper rod 4, are supplied to a summation device 14. The output signal from the summation device 14 is supplied to the valve member 11 for adjustment of the hydraulic cylinder 9 and hence for adjustment of the position of the stopper rod 4. Thus, when the melt has reached up to a certain level in the pouring cup 5, the hydraulic cylinder 9 receives a signal, and the stopper rod 4 is lowered to close the tap hole 3. This regulation can become very exact and is favorable from an environmental point of view. The device illustrated allows the poured weight and/or the pouring rate to be changed within wide limits without any change of the parameters set.

Numeral 16 designates a device for switching to manual control from automatic control which is effected via a line 17.

The reason for the changed signal transmitted by the coil 7 in the case of a rising melt level in the pouring cup 5 is that the reluctance for the electromagnetic flux between the transmitter coil 6 and the receiver coil 7 is changed as melt builds up in the flow path between the transmitter coil 6 and the receiver coil 7. It would, of course, be possible to use several transmitter and receiver coils and these do not necessarily have to be located in close proximity to the stream of melt 8 but can be located at some distance away therefrom.

The transmitter and receiver coils 6, 7 may be located in a plane perpendicular to the stream of melt 8, or in a plane at an acute angle to the stream of melt 8. The pouring cup 5 may be conical, cup-shaped, or otherwise enlarged in relation to the subsequent filling tube in the mold 1.

The transmitter and receiver coils 6, 7 may be located so close to the pouring cup 5 that the flux between these coils is influenced at that level of the melt at which tapping is to be regulated and stopped. By a correct choice of the position of the plane through the coils 6, 7, a high degree of sensitivity the measurement signals can be obtained.

The transmitter coil 6 is, in the case illustrated, supplied with alternating current with a frequency adapted to the particular purpose.

The coils 6, 7 are located immediately above the mold 1, but are directed such that the reluctance in the flow path therebetween is influenced in the case of a change in the level of the pouring cup 5.

Figure 2:
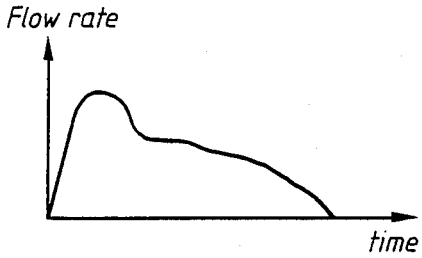
FIG. 2 illustrates graphically the tapping rate (flow rate) as a function of time for a normal flow during filling of a mold.

FIG. 2 shows how, in a typical case the flow rate will rise to a maximum and will then tail off in a controlled fashion as the required volume of melt is attained.

The mold filling control device described can be used with advantage with the channel induction furnace marketed by ASEA AB of Vasterås, Sweden, under the trade Mark PRESSPOUR.

The device illustrated in FIG. 1 can be varied in many ways within the spirit and scope of the following claims.

What is claimed is:

1. A device for controlling the flow of molten metal from a vessel into a mold comprising:

a vessel having valve means for altering the flow of molten metal from the vessel to the mold; and measuring means for measuring the level of molten metal in said mold and emitting a signal, thereby activating the valve means to alter said flow, comprising at least one transmitter coil and at least one receiving coil, the signal from said measuring means being processed by a signal-processing device for controlling said valve means, said coils being close to said mold such that the level of molten metal can be detected by changes in electromagnetic flux between said coils which occur as the level of molten metal changes, the signal from the receiving coil to alter said flow thus being level-dependent, said coils being arranged on different sides of the flow of molten metal from said vessel to said mold.

2. A device according to claim 1 further comprising a pouring cup arranged such that the molten metal enters said pouring cup on its way to the mold and the coils respond to the level of melt in the pouring cup.

* * * * *